United States Patent [19]

Saul

[11] 4,260,964

[45] Apr. 7, 1981

[54] PRINTED CIRCUIT WAVEGUIDE TO MICROSTRIP TRANSITION

[75] Inventor: David L. Saul, El Cajon, Calif.

[73] Assignee: The United States of America as represented by the Secretary of the Navy, Washington, D.C.

[21] Appl. No.: 36,911

[22] Filed: May 7, 1979

[51] Int. Cl.[3] ..... H01P 5/107; H01P 1/162

[52] U.S. Cl. ..... 533/26; 333/34; 333/35; 333/248; 333/251

[58] Field of Search ..... 333/21 R, 26, 34, 35, 333/248, 251

[56] References Cited

U.S. PATENT DOCUMENTS 4,052,683 10/1977 Van Heuven et al. ..... 333/26 X 4,157,516 6/1979 Van de Grijp ..... 333/26

*Primary Examiner*—Paul L. Gensler

[57] ABSTRACT

A waveguide to microstrip transition for transferring guided electromagnetic signals from dominant mode rectangular waveguide to microstrip line and vice versa. A microstrip printed circuit card is disposed in parallel to the narrow walls of a waveguide. The printed circuit card includes a microstrip stepped transformer section followed by a linear taper crossover section. The linear taper crossover section leads into a microstrip line conductor and ground plane for completing the transition.

12 Claims, 8 Drawing Figures

FIG. 1
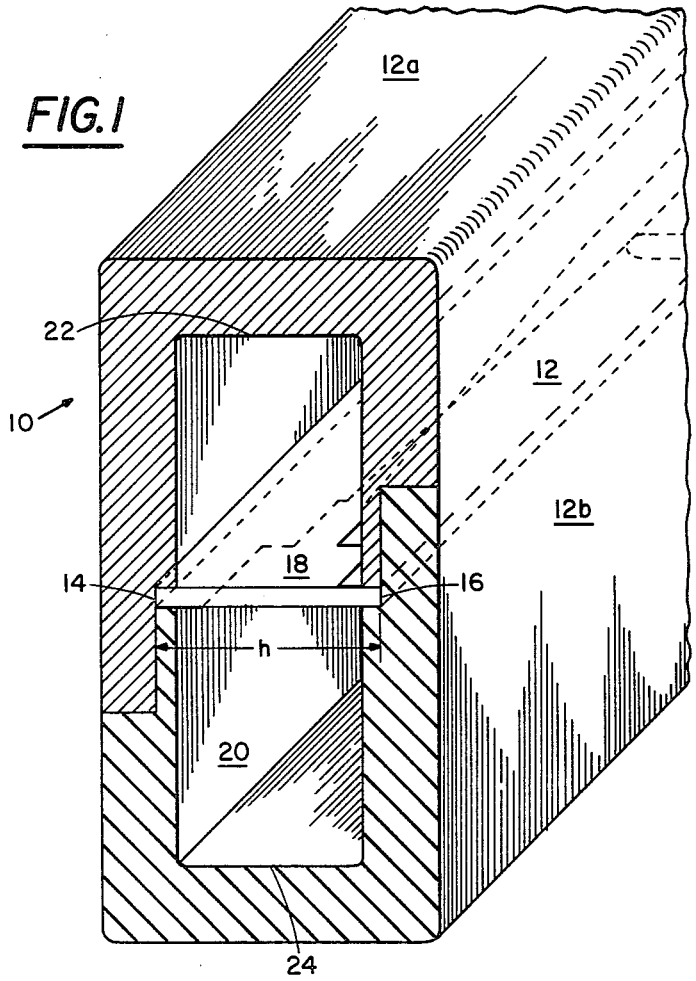
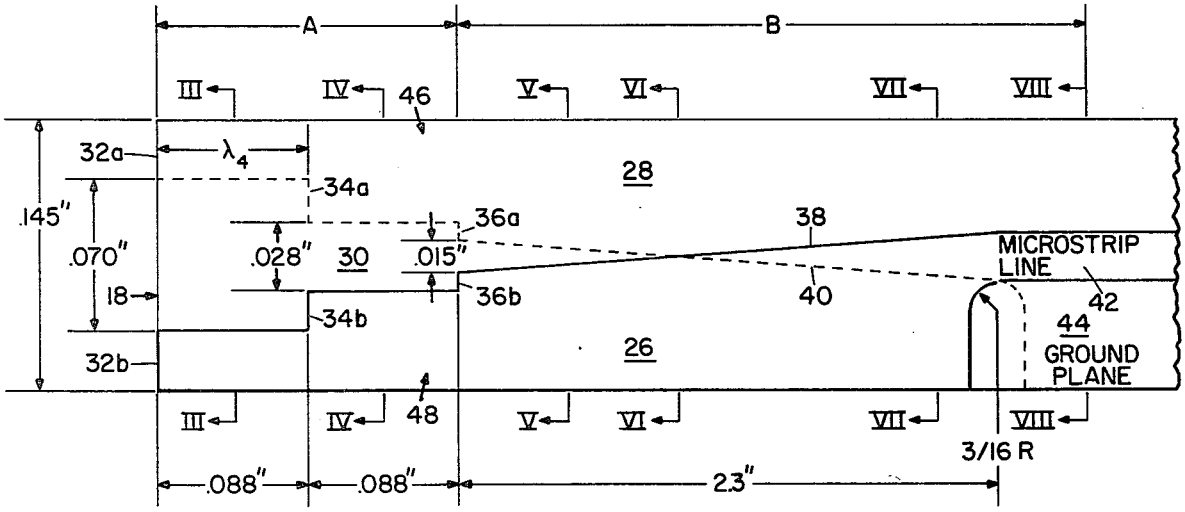
FIG. 2

PRINTED CIRCUIT WAVEGUIDE TO MICROSTRIP TRANSITION

BACKGROUND OF THE INVENTION

The present invention relates generally to the field of microwave devices and more particularly to apparatus for providing a transition from waveguide propagation media to microstrip media. Electromagnetic signal propagation in rectangular waveguides and microstrip lines takes place in different modes. More specifically, the mode commonly designated as $TE_{1,0}$ is employed in dominant mode rectangular waveguides while a quasi-TEM mode is the basis of propagation in a microstrip line. An efficient apparatus to enable transfer of signals between these two kinds of transmission media must perform appropriate mode conversion throughout a suitably wide band of operating frequencies. At the same time, dissipative and radiation losses, along with power reflections, must be kept to a minimum.

A number of different kinds of transitions have been developed in the past and some of these remain in widespread use today. Each has certain advantages and disadvantages when applied to particular situations. Some designs contain frequency sensitive circuit elements that restrict their operation to relatively narrow bands of frequencies. Some are difficult to fabricate and thus quite expensive. Some are difficult to attach to microstrip lines. Some combine these and other shortcomings in various ways.

One such transition is the Van Heuven transition. A detailed description of Van Heuven's device is described in Van Heuven, JHC, "A New Integrated Waveguide-Microstrip Transition", IEEE Trans. MTT, March 1976. Van Heuven's transition utilizes a dielectric substrate inserted in a section of rectangular waveguide. The dielectric substrate is situated in a plane parallel to the waveguide's E-field lines and along the main axis of symmetry. This design uses gradually tapered ridges on opposite sides of the dielectric substrate, concentrating and rotating the electric field within the guide as the ridges come closer together. The taper continues until the ridges are allowed to overlap one another in scissor fashion. As the amount of overlap is increased, wave impedance becomes progressively lower until a value needed to match the microstrip lines is reached. The design of this Van Heuven device has its ridges tapered off to a symmetrical line, i.e. a balanced, parallel plate line. A slotted balun section is required to connect the unbalanced microstrip line. Also a rather complicated arrangement of serrated chokes is used to avoid the need for electrical contact along the walls of the enclosure.

SUMMARY OF THE INVENTION

The present invention provides an improved means of transferring guided electromagnetic signals from a dominant mode of rectangular waveguide to a microstrip transmission line, particularly suitable for operation at frequencies extending into the millimeter wave region. The transition is accomplished by directly converting the waveguide propagation mode through a stepped transformer section followed by a linear taper crossover section and by launching the energy directly into the microstrip medium.

The invention described herein is less complicated than earlier designs although it operates with a very high degree of efficiency and retains desirable features.

In contrast the Van Heuven design described above, the present invention does away with the serrated chokes along the edges of the dielectric substrate, the intermediate section of symmetrical parallel transmission line and the balancing transformer or balun. At the same time, advantages of planar integrated circuit technology which make the Van Heuven design attractive are retained in the present invention. These advantages include fabrication by photolithographic means and incorporation of critical electrical elements as integral parts of a circuit containing microstrip lines.

Smaller size and lower dissipation losses are achieved in the present invention by incorporating a stepped transformer section to reduce the impedance more efficiently prior to beginning the linearly tapered region in which field rotation takes place. Thus, ease of fabrication, high reliability, and relative simplicity can be realized.

OBJECTS OF THE INVENTION

It is the primary object of the present invention to disclose a novel waveguide to microstrip transition apparatus that is extremely simple and inexpensive to manufacture.

Other objects, advantages and novel features of the invention will become apparent from the following detailed description of the invention when considered in conjunction with the accompanying drawings.

BRIEF DESCRIPTION OF THE DRAWINGS

FIG. 1 is an isometric view of the waveguide to microstrip transition apparatus of the present invention illustrating the printed circuit card mounted within its waveguide enclosure.

FIG. 2 is a top view of the microstrip integrated circuit card illustrating the conductor areas and suitable dimensions for a 28–40 GHz transition on a 10 Mil thick Duroid substrate.

DESCRIPTION OF THE PREFERRED EMBODIMENT

Figure 3:
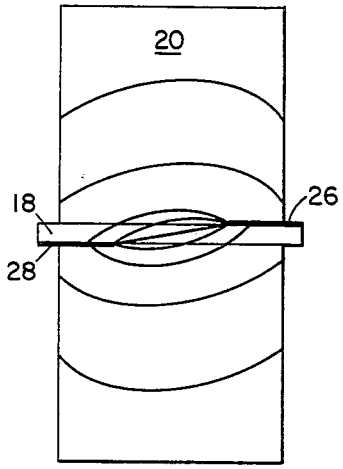
FIGS. 3 through 8 are schematic diagrams of the E-fields present in the transition apparatus of the present invention as seen at the corresponding sections III–VIII in FIG. 2.

Referring now to FIG. 1 there is illustrated the waveguide-to-microstrip transition apparatus 10 of the present invention. The transition 10 is comprised of a waveguide enclosure 12 that is separated into two halves, **12*a* and 12*b*. The waveguide enclosure 12 is constructed so as to include first and second notches 14 and 16 which extend along the broad walls of the waveguide 12 and which are dimensioned so as to receive and secure the printed circuit board 18 within the waveguide cavity 20 as illustrated. The printed circuit board 18 is thus oriented parallel to the waveguide 12 narrow walls 22 and 24. It has been discovered that by constructing the waveguide 12 such that the height of the waveguide, h, as measured between the opposing surfaces of the notches 14 and 16 is less than $\lambda/2$ at the highest operating frequency of the apparatus 10, spurious moding problems within the guide are virtually eliminated. It is to be understood that $\lambda$ is determined for the mixed dielectric medium within the guide 12. The width of the waveguide 12** is of standard dimension, i.e. at least $\lambda/2$ but less than $\lambda$.

Referring now to FIG. 2 the printed circuit card 18 and the structures thereon will now be described. The board 18 is preferably formed of Duroid that is 5–10 Mils thick. On the top surface of the substrate 18 there is bonded or otherwise affixed a first conductive structure generally indicated as 26. Similarly on the undersurface of the substrate 18 there is bonded or otherwise affixed a second conductive structure generally indicated as 28.

Within the region A the conductive structures 26 and 28 form a stepped transformer section 30. The stepped transformer section 30 is comprised of a first pair of steps 32*a* and 32*b*, a second pair of steps 34*a* and 34*b* and a third pair of steps 36*a* and 36*b*. The steps 32*a*, 32*b*, 34*a*, 34*b*, and 36*a* and 36*b* are so arranged that all the reflected energy tends to cancel so that all the power is transmitted in the forward direction. This is accomplished by spacing the steps such that the distance between each pair of steps is approximately $\lambda/4$ at the midband operating frequency of the apparatus 10. The step heights and separations between the structures 26 and 28 in the region A are indicated in FIG. 2 where the substrate is preferably 10 Mil thick Duroid and where, in this exemplary embodiment, the device is intended to be operated in the 28–40 GHz band.

Following the stepped transformer region 30 is a linear taper crossover region B in which the top surface conductive structure 26 overlaps and crosses over the undersurface conductive structure 28. It is noted that within this region B the top surface conductive structure 26 includes a linear edge 38 and the undersurface conductive structure 28 includes a linear edge 40. It has been discovered that the efficiency as well as the operability of the apparatus 10 is dependent in part upon the fact that the edges 38 and 40 are linear and not curved as proposed by Van Heuven.

Following the region B the apparatus 10 includes a microstrip line conductor 42 affixed to the upper surface of the substrate 18 and a ground plane conductor 44 affixed to the undersurface of the dielectric substrate 18. Structures situated in the stepped transformer region A and the linear taper crossover region B are fabricated in the preferred embodiment by photolithographic means as is well known. Preferably, the conductive structures 26 and 28 are metal foil parts which are bonded to the upper and lower surfaces as described above. It is noted that the metal foil structures in regions A and B are integral parts and extensions of the microstrip line 42 and ground plane 44 on the upper and lower surfaces, respectively, of the dielectric substrate 18. When the substrate 18 is positioned within the waveguide enclosure 12 as illustrated in FIG. 1, electrical contact with the waveguide is made along the edges 46 and 48 of the surfaces 28 and 26, respectively, with the waveguide 12.

Figure 4:
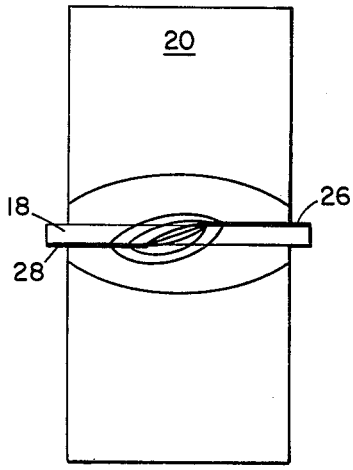
Figure 5:
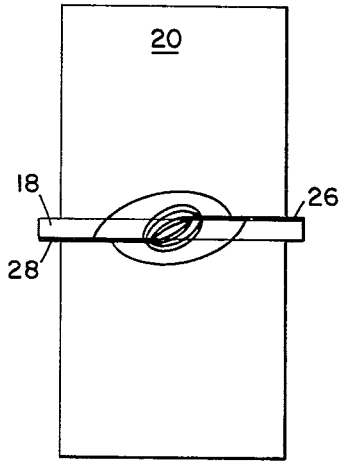
Figure 6:
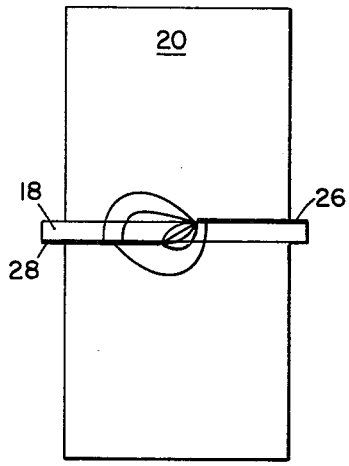
Figure 7:
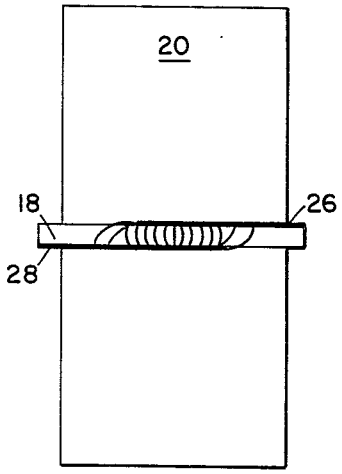
Figure 8:
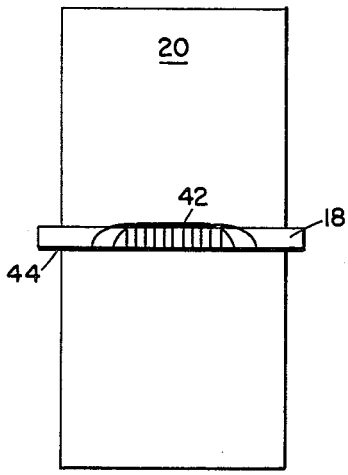

During operation, a waveguide is attached so as to mate with waveguide enclosure 12. The metal foil structures in region A serve as double ridged waveguide loading elements. These are fitted with quarter wave steps as described above for impedance transformation of about 3:1 over a desired band of frequencies. The E-fields propagating within the apparatus 10 are illustrated in FIGS. 3 through 8 where a greater density of lines indicates more intense field strength. In region B a $\pi/2$ rotation of electric field takes place as the metal foil elements 26 and 28 cross over and overlap one another. Proceeding through region B toward the microstrip line 42, a further reduction of impedance occurs. This is brought about by a gradual increase in capacitance per unit length as the foil conductors 26 and 28 come into close proximity and eventually overlap one another with the dielectric substrate 18 between them. At the end of the region B, the concentration and orientation of electric and magnetic fields closely resembles those of microstrip line, thus permitting direct launching into microstrip line without a balun of intermediate balanced line structure of the sort used by Van Heuven and others. It is noted that radiation in a waveguide mode, i.e. other than the TEM or quasi-TEM mode, is quite impossible beyond region B because the ground plane 44 effectively short-circuits the waveguide.

In a 26–40 GHz wideband transition, three steps are typically employed in region A. It is to be understood, however, that it is within the scope of this invention that a different number of steps may be utilized. The waveguide enclosure 12 may be discontinued after region B since there is no waveguide propagation beyond that region.

Other means of supporting the metal foil structures 26 and 28 in regions A and B of the apparatus 10 could be utilized. For example, suspended substrate microstrip could be fed by a structure consisting of metal foil elements mounted on the inner surfaces of parallel dielectric slabs, thus leaving air dielectric in the "crossover" region. There are yet other arrangements possible, such as rigid, self-supporting circuit elements. Also, the waveguide enclosure 12 can be fabricated in two or more parts so as to facilitate assembly and/or disassembly of the various parts. Any of various soft or hard dielectric materials could be used for the dielectric substrate 18.

Obviously many modifications and variations of the present invention are possible in the light of the above teachings. It is therefore to be understood that within the scope of the appended claims the invention may be practiced otherwise than as specifically described.

What is claimed is:

1. A waveguide to microstrip transition apparatus comprising:

a waveguide having first and second narrow walls and first and second broad walls;

a dielectric substrate mounted within said waveguide and having a top surface and a bottom surface;

a stepped transformer section disposed on said dielectric substrate top and bottom surfaces;

a linear taper crossover section connected to said stepped transformer section and including a first conductor section including a first conductor edge disposed on said dielectric substrate top surface and a second conductor section including a second conductor edge disposed on said dielectric substrate bottom surface, said first conductor edge crossing over said second conductor edge in scissors-like manner;

a microstrip line conductor connected to said linear taper crossover section and disposed on said dielectric substrate top surface; and a ground plane conductor disposed on said dielectric substrate bottom surface and connected to said linear taper crossover section.

2. The apparatus of claim 1 wherein the plane of said dielectric substrate is parallel to said waveguide narrow walls.

3. The apparatus of claim 1 wherein said waveguide includes first and second notches extending along said waveguide broad walls for receiving and securing said dielectric substrate.

4. The apparatus of claim 3 wherein said first and second notches include first and second opposing surfaces, respectively, and wherein the distance between said opposing surfaces is less than $\lambda/2$ where $\lambda$ is the wavelength at the highest operating frequency of said apparatus.

5. The apparatus of claim 3 wherein said stepped transformer section is continuously grounded to said waveguide along the entire length of said stepped transformer section.

6. The apparatus of claim 3 wherein said stepped transformer section comprises:

a first conductor section disposed on said dielectric substrate top surface and having a series of stepped ridges; and a second conductor section disposed on said dielectric substrate bottom surface and having a series of stepped ridges.

7. The apparatus of claim 6 wherein said first and second conductors of said transformer section are symmetrical.

8. The apparatus of claim 1 wherein said first conductor edge is a straight edge and extends from said stepped transformer section to said microstrip line conductor and said second conductor edge is a straight edge and extends from said stepped transformer section to said ground plane conductor.

9. The apparatus of claim 1 wherein said stepped transformer section and said linear taper crossover section are electrical conductors.

10. The apparatus of claim 1 wherein said linear taper crossover section first conductor section and said crossover section second conductor section are substantially symmetrical.

11. The apparatus of claim 1 wherein said linear taper crossover section introduces a 90° rotation of the electric field of an electromagnetic wave propagation therethrough.

12. In a waveguide to microstrip transition apparatus including a waveguide having first and second broadwalls and first and second narrow walls, a dielectric substrate mounted within said waveguide, having a top and bottom surface and having waveguide-to-microstrip transition conductors disposed on said top and bottom surfaces, the improvement comprising:

first and second notches extending along said waveguide broadwalls for receiving and securing said dielectric substrate, said first and second notches including first and second opposing surfaces, respectively, and the distance between said opposing surfaces being less than $\lambda/2$ where $\lambda$ is the wavelength at the highest operating frequency of said apparatus.

* * * * *